United States Patent [19]

Sansevero

[11] Patent Number: 4,533,271

[45] Date of Patent: Aug. 6, 1985

[54] WRITING INSTRUMENT WITH PLURAL IMPLEMENTS CAM ACTUATED

[76] Inventor: Nick Sansevero, 2062 W. 4th St., Brooklyn, N.Y. 11223

[21] Appl. No.: 541,156

[22] Filed: Oct. 12, 1983

[51] Int. Cl.[3] ..... B43K 24/10; B43K 24/14; B43K 27/12

[52] U.S. Cl. ..... 401/29; 401/30; 401/32

[58] Field of Search ..... 401/29, 30, 32

[56] References Cited

U.S. PATENT DOCUMENTS

| | | | |
|---|---|---|---|
| 940,247 | 11/1909 | Haring | 401/32 |
| 1,697,437 | 1/1929 | Stout et al. | 401/30 |
| 2,434,234 | 1/1948 | Thatcher | 401/32 |
| 3,816,006 | 6/1974 | Tailer | 401/30 |

FOREIGN PATENT DOCUMENTS

| | | | |
|---|---|---|---|
| 808421 | 7/1951 | Fed. Rep. of Germany | 401/32 |
| 2450583 | 5/1976 | Fed. Rep. of Germany | 401/30 |
| 1270645 | 7/1961 | France | 401/32 |
| 589077 | 2/1959 | Italy | 401/32 |

*Primary Examiner*—Steven A. Bratlie

*Attorney, Agent, or Firm*—Lowell M. Rubin

[57] ABSTRACT

A writing instrument having two writing elements is described. A tubular cam is utilized together with cam followers and element holders for each writing element and associated supporting structure to provide an instrument which will position one element in the extended position while positioning the second element in the retracted position without the use of springs, will lock each element in its respective position and which will be simple to assemble and maintain.

2 Claims, 10 Drawing Figures

Fig. 1.
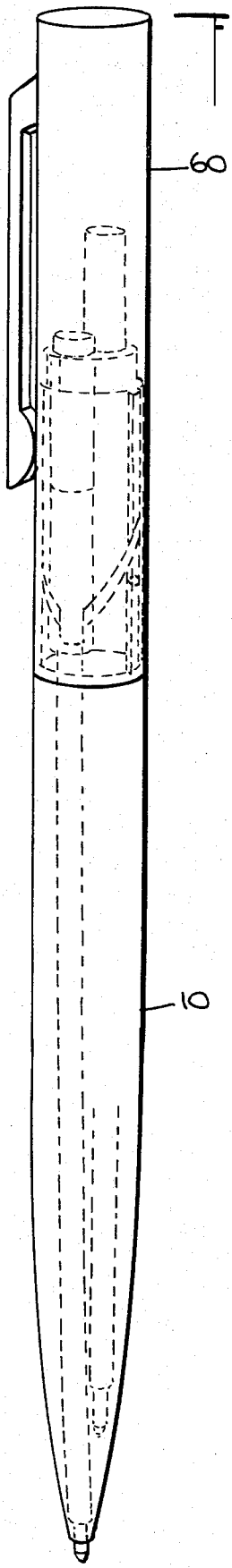
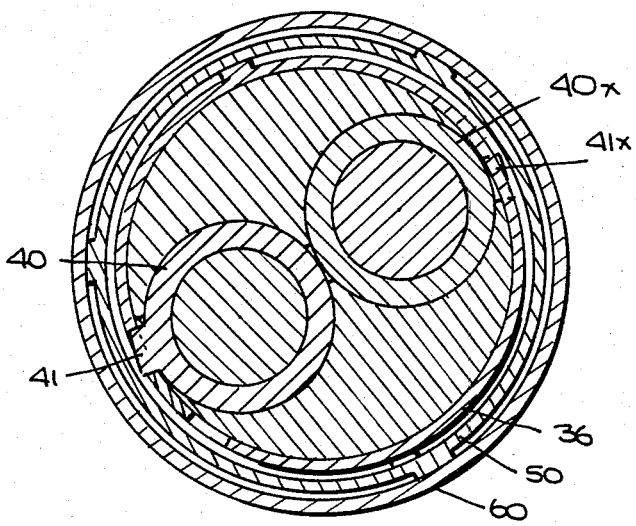
Fig. 9.
Fig. 10.
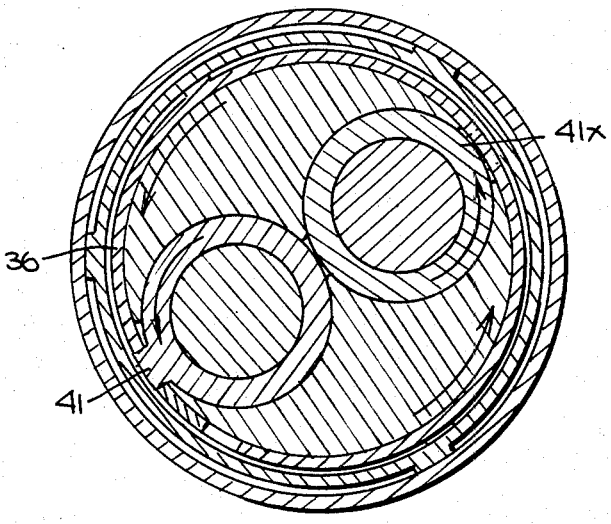

WRITING INSTRUMENT WITH PLURAL IMPLEMENTS CAM ACTUATED

BACKGROUND OF THE INVENTION

Two color writing instruments are well known in the art. Presently known two color instruments have not achieved the caliber of fine single element instruments. Various existing two color instruments utilize means to extend or retract writing elements which allow the simultaneous extension of the two elements thus jamming the instrument; fail to positively lock writing elements so as to prevent pressure exerted on the point of the device from causing the separation of the parts of the instrument; have complex mechanisms which utilize coil springs to assist in the positioning of the writing instruments; are difficult and inconvenient to assemble; are unreliable and subject to failure; and, ultimately fail to provide the smooth positive functioning associated with a high quality personal writing instrument.

SUMMARY OF THE INVENTION

It is a principal object of this invention to provide a two color writing instrument which will positively position both elements simultaneously, retracting one while advancing the second. Another object of the present invention is to provide an instrument which functions without the use of springs and which locks the individual elements in either the extended or the retracted position. A further object of the present invention is to provide an instrument which is simple to fabricate and to assemble; one in which writing elements can be changed without disassembling the device, and one which will provide the reliability, long useful life, smooth positive action and overall quality of a fine personal writing instrument.

The present invention contemplates a two color writing instrument which comprises a lower tubular barrel with a tapered lower end having a hole therein through which the selected writing element will project; two writing elements positioned in said barrel, the upper portions of which project through a cylindrical member and through cam followers slidably located in said cylindrical member; said elements having upper ends secured by refill holders which threadedly interconnect with said cam followers.

Each of said cam followers has a lug or projection which extends through diametrically opposed longitudinal slots in the periphery of said cylindrical member, each of which said lugs is positively operated upon by a tubular cam which is coaxial with, and closely surrounds, said cylindrical member. The said cam is so constructed that when engaged with the lugs on the associated cam followers, the said cam followers may not both be in the extended position simultaneously. Rotation of the tubular cam about its longitudinal axis, coupled with the restraint of the longitudinal slots, causes the cam followers to move in opposite directions such that one follower progresses toward the extended position while the second follower progresses toward the retracted position. The said tubular cam is in turn contained within a tubular retaining sleeve. The said cylindrical member, tubular cam and retaining sleeve may be sized such that a cap completing the writing instrument can be matched to the said barrel in both size and construction.

As taught herein, the cylindrical member, cam followers, tubular cam and retaining sleeve are first assembled. The completed assembly is then inserted into the barrel wherein the lower portion of said cylindrical member is so sized as to be press fitted into said barrel, securely joining said assembly to said barrel. Each writing element is then mated with its refill holder and inserted downwardly through their respective cam follower until each of said refill holders can be threaded into said cam followers. The cap is thereupon placed over the said assembly to complete the instrument. In alternate embodiments, the cylindrical member may be lenghtened downwardly to itself form the lower barrel or may be formed with a threaded lower end such that a barrel may be placed over this extended cylindrical member and retained by the engagement of a lower nose piece which would threadedly interconnect with the cylindrical member.

As will be described more fully herein, the said cylindrical member, cam and cam follower combine to provide both smooth, positive control of the writing elements and direct mechanical operation, without the use of springs which are principal objects of this invention.

BRIEF DESCRIPTION OF THE DRAWINGS

FIG. 1 is a front perspective elevation of a writing instrument embodying the present invention with a phantom view of internal components.

FIG. 9 is a sectional view taken along the lines 9—9 in FIG. 7.

FIG. 10 is a further sectional view as in FIG. 9 showing the unlocking of various elements.

DESCRIPTION OF THE PREFERRED EMBODIMENT

Figure 2:
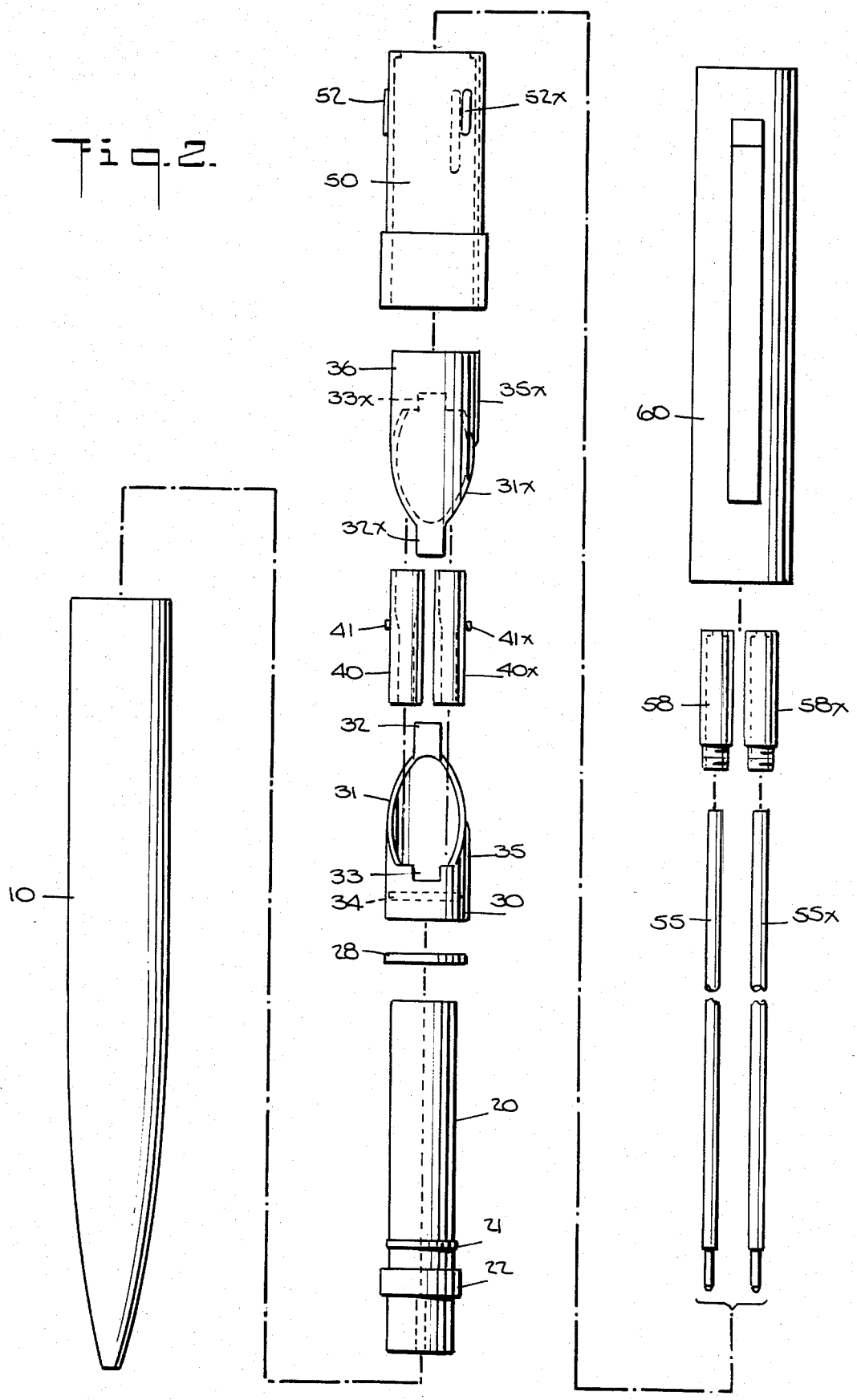
FIG. 2 is an exploded elevation of the said writing instrument.

Referring to the drawings, the outward appearance of a writing instrument embodying the invention herein is in the known form of a lower cylindrical barrel 10 and cap 60. The barrel tapers at the lower end to a small opening through which the chosen writing element, 55 or 55*x*, will project. A cylindrical member 20 having a collar 22 is first assembled with cam followers, cam and tubular retaining sleeve and then press fit into the open upper end of the barrel to form a substantially permanent connection. The cylindrical member 20 has two longitudinal compartments 23 and 23*x* each of which extend through the member. These longitudinal compartments are of identical circular cross section and of two differing diameters. The diameter of the upper portion of the compartments are slightly smaller than the radius of the cylindrical member such that when the two compartments are adjacent to each other with their centers lying on a diameter of the cylindrical member, their circumferences are substantially tangent at the center of the member and coincident to the circumference of the member at the ends of the diameter. The longitudinal compartments maintain the upper dimension from the top of the cylindrical member to approximately the upper edge of the collar 22. The lower compartments are coaxial with the upper compartments but of a smaller diameter, generally of a dimension sufficient to allow the free passage of the writing elements 55 and 55*x*.

Two tubular followers 40 and 40*x* are sized to slide freely in the upper longitudinal compartments. Each of the followers has a circular longitudinal passage of a diameter sized to allow the free passage of the writing elements 55 and 55*x*. In addition, the upper portion of the passage is slightly enlarged and provided with a female thread to which the refill holders 58 and 58*x* are threadedly connected. The refill holders in turn, contain means for engaging the writing elements 55 and 55*x*. The nature of these means is such that the original elements may be removed and discarded and replaced with new elements when desired.

Each of the longitudinal compartments 23 and 23*x* contain a longitudinal slot 24 or 24*x* located at the ends of the diameter of the cylindrical member defined by the centers of the compartments. Each of these slots extends from the top of the member to a point above the annular ring 21. Each of the tubular followers 40 and 40*x* has a lug 41 or 41*x* which extends radially outwardly from the body of the follower and through the slots 24 or 24*x*. The lugs and the slots are cooperatively sized so that the lug may move freely throughout the length of the slot but with minimum sidewise play. Each of the slots 24 and 24*x* are further provided with recesses in their upper and lower portions 25 or 25*x* and 26 or 26*x* which define the upper and lower limit of travel for the lug and enable the lugs and entire associated structure to be positively locked in either the extended or retracted positions.

Figures 3, 4, 5, 6:
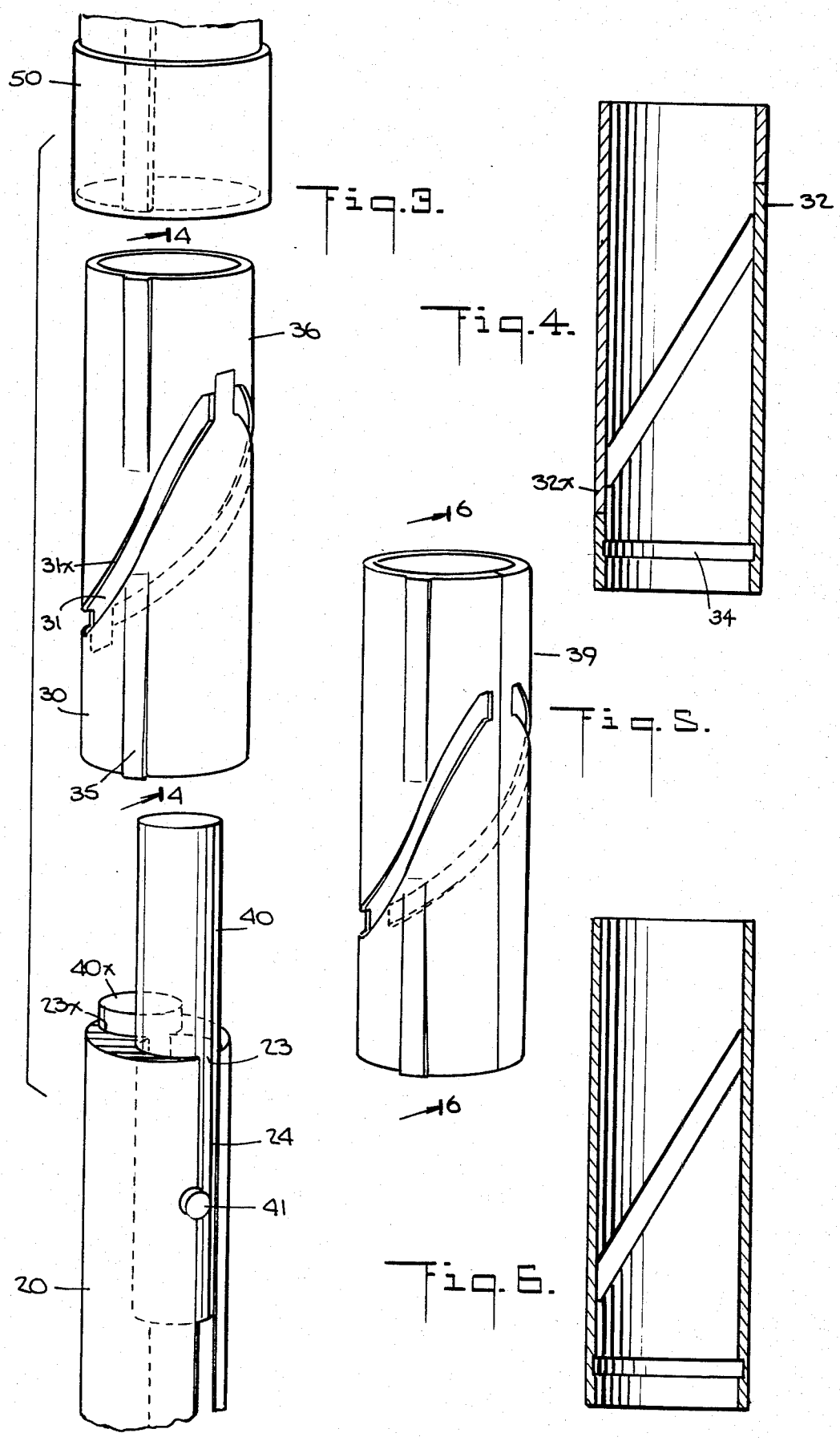
FIG. 3 is an enlarged partial perspective explosion showing the interrelation of the cylindrical member, cam followers, tubular cam and retaining sleeve.
FIG. 4 is a sectional view taken along the lines 4—4 in FIG. 3.
FIG. 5 is a perspective elevation of an alternate tubular cam embodiment.
FIG. 6 is a sectional view taken along the lines 6—6 in FIG. 5.

The lugs and associated structure are operated on by the tubular cam 39. As shown in FIGS. 3 and 5, the tubular cam is comprised of a hollow cylinder of material with two diametrically opposed helical slots set in the cylinder walls. Each of the slots is in turn comprised of an upper and lower cam surface. As shown in the figures, the slots are mirror images in that their upper and lower terminations are adjacent to each other. By so placing the slots, rotation of the tubular cam about its longitudinal axis, coupled with the restraints imposed by the longitudinal slots, will cause a cam follower in one longitudinal compartment to move upward while a follower in the opposite compartment will be caused to move downward.

Figure 7:
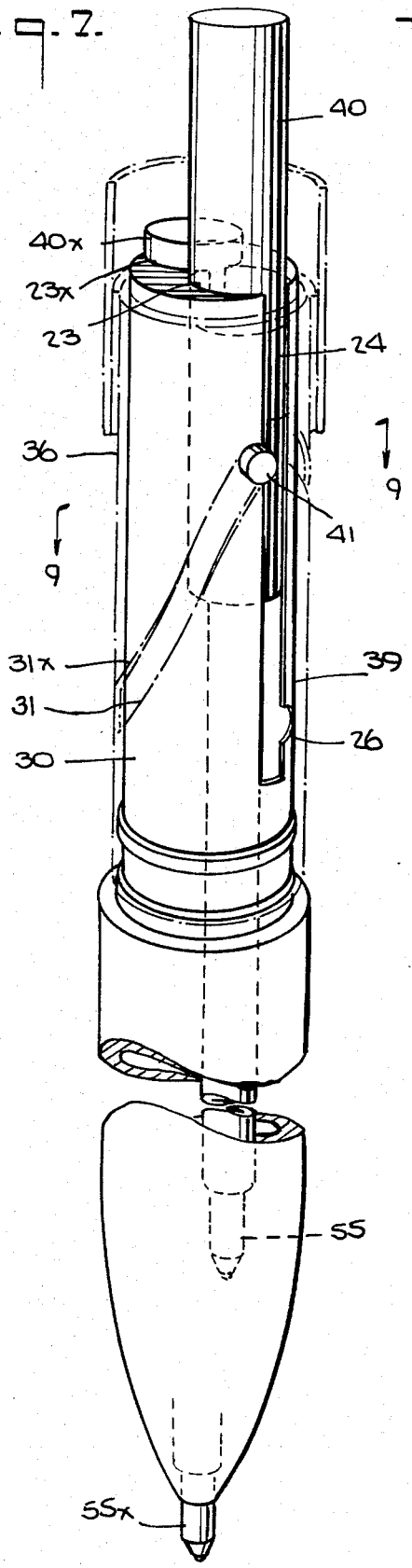
FIG. 7 is a perspective elevation depicting the interrelation of the various elements of the invention herein.
Figure 8:
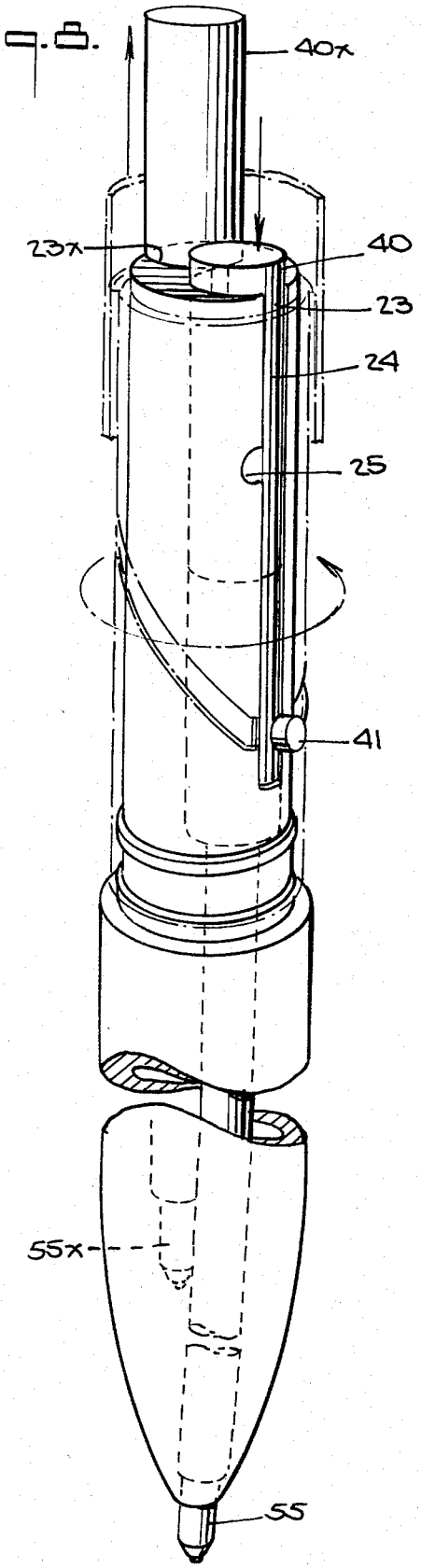
FIG. 8 is a perspective elevation as in FIG. 7 wherein the operative writing elements have been interchanged.

This effect is shown in FIGS. 7 and 8. Maintaining the positioning of the writing instrument with respect to the viewer, FIG. 7 presents the writing element farthest from the viewer 55*x* in the extended position. The element nearest the viewer, 55, is in its retracted position. The associated tubular follower 40 is in its uppermost position with the lug 41 locked into the recess 25. The tubular cam is thereafter turned to the right in the direction of the rotational arrow in FIG. 8. The lug 41 is acted upon by the upper cam surface 31*x* which initially forces the lug out of the recess 25. This is most clearly shown in FIGS. 9 and 10. In FIG. 9, the lugs 41 and 41*x* can be seen to be rotated, each in a general clockwise direction, beyond the diameter defined by the centers of their respective followers 40 and 40*x*. As the cam 36 begins to move in a counterclockwise direction, the lugs 41 and 41*x* are also rotated, out of their respective recesses, and into alignment with the longitudinal slots in the cylindrical member which will allow their further longitudinal travel.

Due to the constraints to the motion of the lug imposed by the slot 24, further rotation of the tubular cam is translated into vertical motion of the lug, associated cam follower and writing element. As the cam completes its rotation, the lug 41 is forced into the lower recess 26 where it is again locked, in this case preventing pressure on the now extended element 55 from causing the partial retraction of the element or the separation of the writing instrument.

A feature of the preferred embodiment of this invention is the formation of the tubular cam in an upper and lower sections 30 and 36. The two sections are mated by the joining of tangs 32 and 32*x* and associated recesses 33 and 33*x*. The tangs provide for the positive positioning of the upper and lower cams creating the operative whole while also creating the physical terminations of the cam slots.

In assembling the operative elements of the invention, the cylindrical member would first be placed in a jig and a washer 28 placed over the upper portion of the member until it comes to rest on the shoulder of the collar 22. The lower tubular cam 30 is next placed over the cylindrical member 20 and positively positioned by the interaction of the annular ring 21 and mating annular groove 34. The washer 28 assists in the positioning of the cam and provides sufficient friction to control unwanted rotation of the cam and to impart the desired feel to the operation of the instrument. The tubular followers 40 and 40*x* are next inserted into their associated longitudinal compartments with the lugs 41 and 41*x* entering into the slots 24 and 24*x*. The upper tubular cam 36 is thereupon placed over the cylindrical member 20 and the respective tangs 32 and 32*x* engaged into their associated recesses 33 and 33*x*. The cam members are held in the appropriate relationship by the interaction of the respective tangs and recesses. Tubular retaining sleeve 50 is then placed over the upper and lower cams with the ribs 35 and 35*x* engaging a corresponding longitudinal groove in the retaining sleeve. The interior diameter of the tubular retaining sleeve is such that pressure must be applied to force it down over the cam members. The upper cam member is further retained by a slight crown formed in the upper end of the tubular sleeve. The positioning of the sleeve locks the two portions of the cam together forming in effect a single tubular cam while providing the simple assembly noted.

An alternative cam embodiment is shown in FIGS. 5 and 6. FIG. 5 shows a single element cam formed from a thin sheet of material which is then rolled until the ends butt. It can be seen by comparing the sectional drawings, FIGS. 4 and 6, that the completed structure is functionally identical to that created by the two piece cam. Here again, the cam is held by the tubular sleeve.

The completed assembly is then press fit into the upper end of the barrel 10. The writing elements 55 and 55*x* are mated with their respective refill holders 58 and 58*x* and inserted through the appropriate tubular follower. The cam assembly is then rotated to raise each follower so that the associated holder may be threadedly attached. The cap 60 may then be placed over the tubular retaining sleeve 50 engaging the ribs 52 and 52*x*, completing the assembly. Should it be desired to change a writing element, the cap 60 may be removed and the sleeve 50 rotated until the desired element and holder 58 or 58$x$ in its uppermost position. The holder may then be unscrewed from its associated follower and the holder and element removed from the instrument. The elements may be replaced and the instrument reassembled.

I claim:

1. A writing instrument comprising:

a cylindrical member having two longitudinal compartments therein, each said longitudinal compartment having a longitudinal slot in the periphery thereof; and a tubular cam follower slidably located in each of said compartments, each of said followers having a lug extending radially outward from the body of said follower and through the said longitudinal slots; and a tubular cam which is coaxial with and closely surrounds the said cylindrical member, said cam being capable of rotation about said cylindrical member, said tubular cam being formed of a lower section and an upper section, each said section having a tang projecting from the point of its longest linear dimension and each such section having a recess to accept said tang at the point of its shortest linear dimension, the said upper and lower sections being joined so as the tang of each engages the recess of the other, the said sections so joined forming two diameterically opposed helical slots in the periphery of the said tubular cam; and a tubular retaining sleeve closely surrounding the said tubular cam; and a lower tubular barrel with tapered lower end having a hole therein through which a writing element may project; and two writing elements, each extending downwardly through one of said followers and through one of said compartments; and means for securing each of said writing elements to one of said cam followers; and a cap.

2. A writing instrument comprising:

a cylindrical member having two longitudinal compartments therein, each of the said longitudinal compartments having an upper portion and a lower portion, both of the said portions being of circular cross section and coaxial, the axis of the two said compartments lying on the same diameter of the said cylindrical member, the diameter of the said upper portion being slightly smaller than the radius of the cylindrical member, each of the said upper portions having a longitudinal slot in the periphery thereof, the said slots being diametrically opposed and located at the closest coincidence of the periphery of the said upper portion and the said cylindrical member; and a tubular cam follower slidably located in each of the said upper portions of the said compartments, each of the said followers having a lug extending radially outward from the body of the said follower and through the said longitudinal slot; and a tubular cam which is coaxial with and closely surrounds the said cylindrical member, said tubular cam being rotatable about said cylindrical member, said tubular cam being formed of a lower section and an upper section, each said section having a tang projecting from the point of its longest linear dimension and each such section having a recess to accept said tang at the point of its shortest linear dimension, the said upper and lower sections being joined so as the tang of each engages the recess of the other, the said sections so joined forming two diametrically opposed helical slots in the periphery of the said tubular cam; and a tubular retaining sleeve closely surrounding the said tubular cam; and a lower tubular barrel with tapered lower end having a hole therein through which a writing element may project; and two writing elements, each extending downwardly through one of the said followers and through one of the said compartments; and two refill holders, each of the said holders having means for engaging the said writing elements and further means for connecting the said holders to the said followers; and a cap.

* * * * *